US007375617B2

(12) United States Patent
Stirling

(10) Patent No.: US 7,375,617 B2
(45) Date of Patent: May 20, 2008

(54) EVACUATION APPLIANCE

(75) Inventor: Christopher D. Stirling, Holland, MI (US)

(73) Assignee: Gentex Corporation, Zeeland, MI (US)

( * ) Notice: Subject to any disclaimer, the term of this patent is extended or adjusted under 35 U.S.C. 154(b) by 39 days.

(21) Appl. No.: 11/358,025

(22) Filed: Feb. 21, 2006

(65) Prior Publication Data

US 2006/0187075 A1 Aug. 24, 2006

Related U.S. Application Data

(60) Provisional application No. 60/655,078, filed on Feb. 22, 2005.

(51) Int. Cl.
*G08B 3/00* (2006.01)

(52) U.S. Cl. ..... 340/384.1; 340/331; 340/332; 340/627; 340/628; 340/693.5; 340/693.12

(58) Field of Classification Search ..... 340/384.1, 340/331, 332, 627, 628, 693.5, 693.12
See application file for complete search history.

(56) References Cited

U.S. PATENT DOCUMENTS 5,602,522 A * 2/1997 Pacelli ..... 340/331
5,748,089 A * 5/1998 Sizemore ..... 340/574
5,969,627 A * 10/1999 Tarlton et al. ..... 340/693.12
6,411,201 B1 * 6/2002 Hur et al. ..... 340/332
7,026,948 B1 * 4/2006 Rutter et al. ..... 340/693.5

* cited by examiner

*Primary Examiner*—Tai Nguyen
(74) *Attorney, Agent, or Firm*—Price, Heneveld, Cooper, DeWitt & Litton, LLP

(57) ABSTRACT

An evacuation appliance comprising a mounting plate configured to be connected to a wall, with the mounting plate having a terminal clip. The evacuation appliance further includes a notification device having at least one notification member, with the notification device being configured to be connected to the mounting plate to electronically connect the terminal clip to the at least one notification member to power the at least one notification member. The mounting plate and the notification device comprise an accessible testing system, such that when the mounting plate and the notification device are connected, the notification device can be measured using the accessible testing system to determine if the notification device is properly receiving power from the terminal clip without disconnecting the notification device from the mounting plate.

24 Claims, 11 Drawing Sheets

EVACUATION APPLIANCE

CROSS-REFERENCE TO RELATED APPLICATION

This application claims the benefit of U.S. Provisional Application No. 60/655,078, filed Feb. 22, 2005.

FIELD OF THE INVENTION

The present invention concerns evacuation appliances, and more particularly relates to improvements to evacuation appliances.

BACKGROUND OF THE INVENTION

Heretofore, various notification and evacuation systems have been utilized in areas of commercial and residential buildings as well as in outside areas for the purpose of attracting the attention of persons in such areas, as for example, to warn of the danger of a fire or to alert such persons to a telephone call or for a myriad of other purposes. Many prior evacuation systems include a plurality of devices that emit an audible and/or visual alarm. The systems which incorporate these devices typically include multiple devices which are wired in parallel to a common alarm source. However, if there is a malfunction in one of the devices or if there is a ground fault in one of the devices, it may be difficult to easily determine which device is malfunctioning.

Accordingly, an apparatus is desired having the aforementioned advantages and solving and/or making improvements on the aforementioned disadvantages.

SUMMARY OF THE PRESENT INVENTION

An aspect of the present invention is to provide an evacuation appliance comprising a mounting plate configured to be connected to a wall, with the mounting plate having a terminal clip. The evacuation appliance further includes a notification device having at least one notification member, with the notification device being configured to be connected to the mounting plate to electronically connect the terminal clip to the at least one notification member to power the at least one notification member. The mounting plate and the notification device comprise an accessible testing system, such that when the mounting plate and the notification device are connected, the notification device can be measured using the accessible testing system to determine if the notification device is properly receiving power from the terminal clip without disconnecting the notification device from the mounting plate.

Another aspect of the present invention is to provide a method of testing an evacuation appliance comprising providing a mounting plate configured to be connected to a wall, with the mounting plate having a terminal clip. The method also includes providing a notification device having at least one notification member and connecting the notification device to the mounting plate to electronically connect the terminal clip to the at least one notification member to power the at least one notification member. The method further includes testing the at least one notification member using an accessible testing system to determine if the notification device is properly receiving power from the terminal clip without disconnecting the notification device from the mounting plate.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
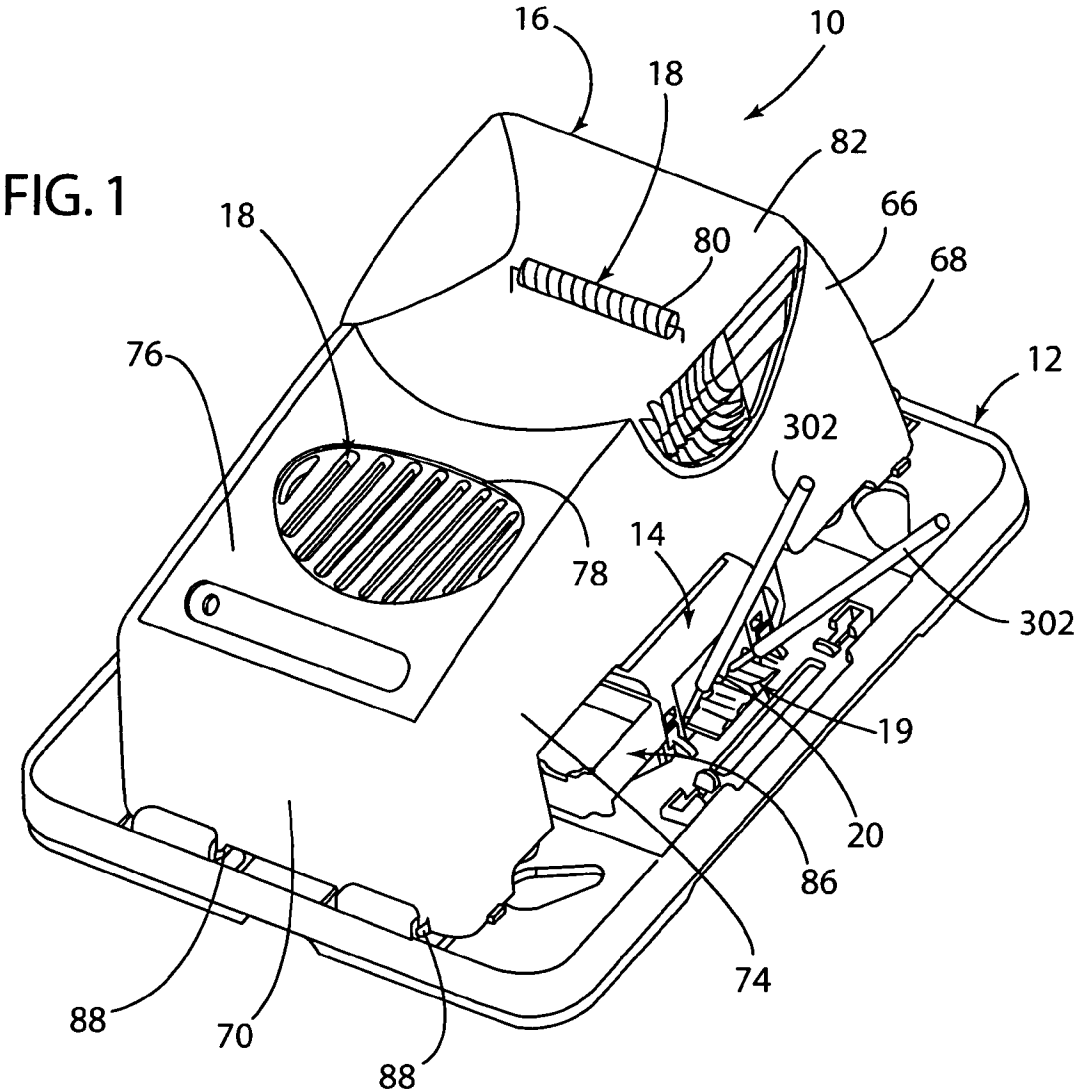
FIG. 1 is a first perspective view of an evacuation appliance embodying the present invention.

Reference will now be made in detail to the present preferred embodiments of the invention, examples of which are illustrated in the accompanying drawings. Wherever possible, the same reference numerals will be used throughout the drawings to refer to the same or like parts.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates an evacuation appliance of the present invention. The evacuation device 10 comprises a mounting plate 12 configured to be connected to a wall, with the mounting plate 12 having a terminal clip 14. The evacuation appliance 10 further includes a notification device 16 having at least one notification member 18. The notification device 16 is configured to be connected to the mounting plate 12 to electronically connect the terminal clip 14 to the at least one notification member 18 to power the at least one notification member 18. The mounting plate 12 and the notification device 16 comprise an accessible testing system 19, such that when the mounting plate 12 and the notification device 16 are connected, the notification device 16 can be measured using the accessible testing system to determine if the notification device 16 is properly receiving power from the terminal clip 14 without disconnecting the notification device 16 from the mounting plate 12. In the illustrated example, the testing system 19 comprises at least one test node 20 for measuring a voltage across the notification device 16.

Figure 2:
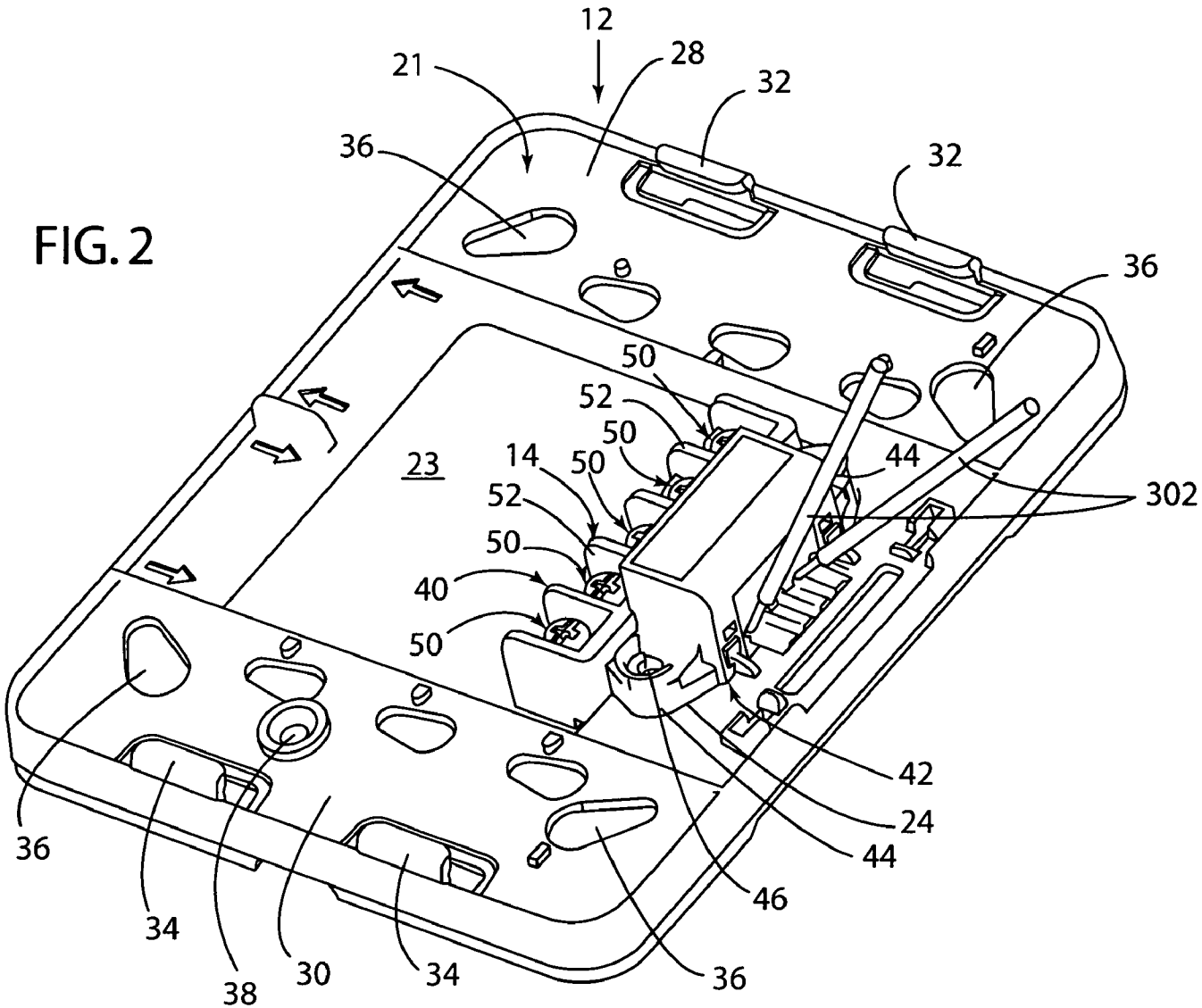
FIG. 2 is a perspective view of a mounting plate and terminal clip of the evacuation appliance embodying the present invention.
Figure 3:
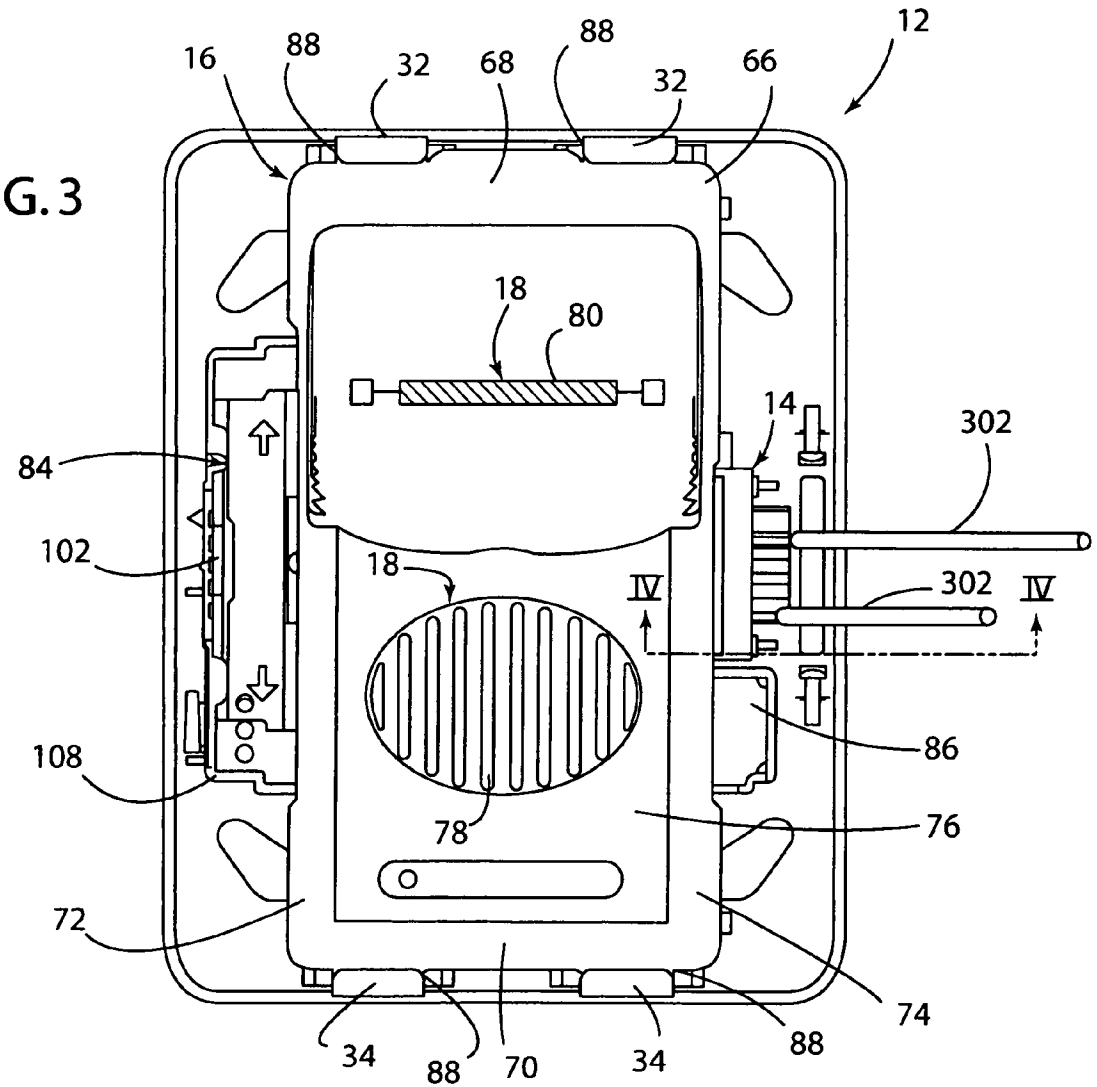
FIG. 3 is a front view of the evacuation appliance embodying the present invention.

In the illustrated example, the mounting plate 12 (FIG. 2) includes the terminal clip 14 and is configured to connect the notification device 16 to the terminal clip 14. The mounting plate 12 is preferably made of metal, although other materials are contemplated. The mounting plate 12 comprises a base 21 having a center opening 23 and a terminal clip recess 24 for accepting the terminal clip 14. The terminal clip recess 24 is adjacent the center opening 23 and includes a pair of openings. As discussed in more detail below, the terminal clip 14 is connected to the base 21 by inserting screws through the terminal clip 14 and into the openings. However, it is contemplated that the terminal clip 14 could be connected to the base 21 in any manner and it is even contemplated that the base 21 and the terminal clip 14 could be integral. The base 21 further includes an upper panel 28 above the center opening 23, a lower panel 30 below the center opening 23, upper flanges 32 and lower flanges 34. As discussed in more detail below, the upper panel 28, the lower panel 30, the upper flanges 32 and the lower flanges 34 are used to connect the notification device 16 to the mounting plate 12. While two upper flanges 32 and two lower flanges 34 are shown, it is contemplated that any number of upper flanges 32 and lower flanges 34 could be used (including only one each). The upper panel 28 and the lower panel 30 each include a plurality of wall connection openings 36 configured to accept fasteners therein to connect the mounting plate 12 to a wall and/or an electrical box having connections for the evacuation appliance 10. Furthermore, the lower panel 30 includes a device connection opening 38 for accepting a fastener through the notification device 16 and into the device connection opening 38 to securely connect the at least one notification device 16 to the mounting plate 12.

Figure 4:
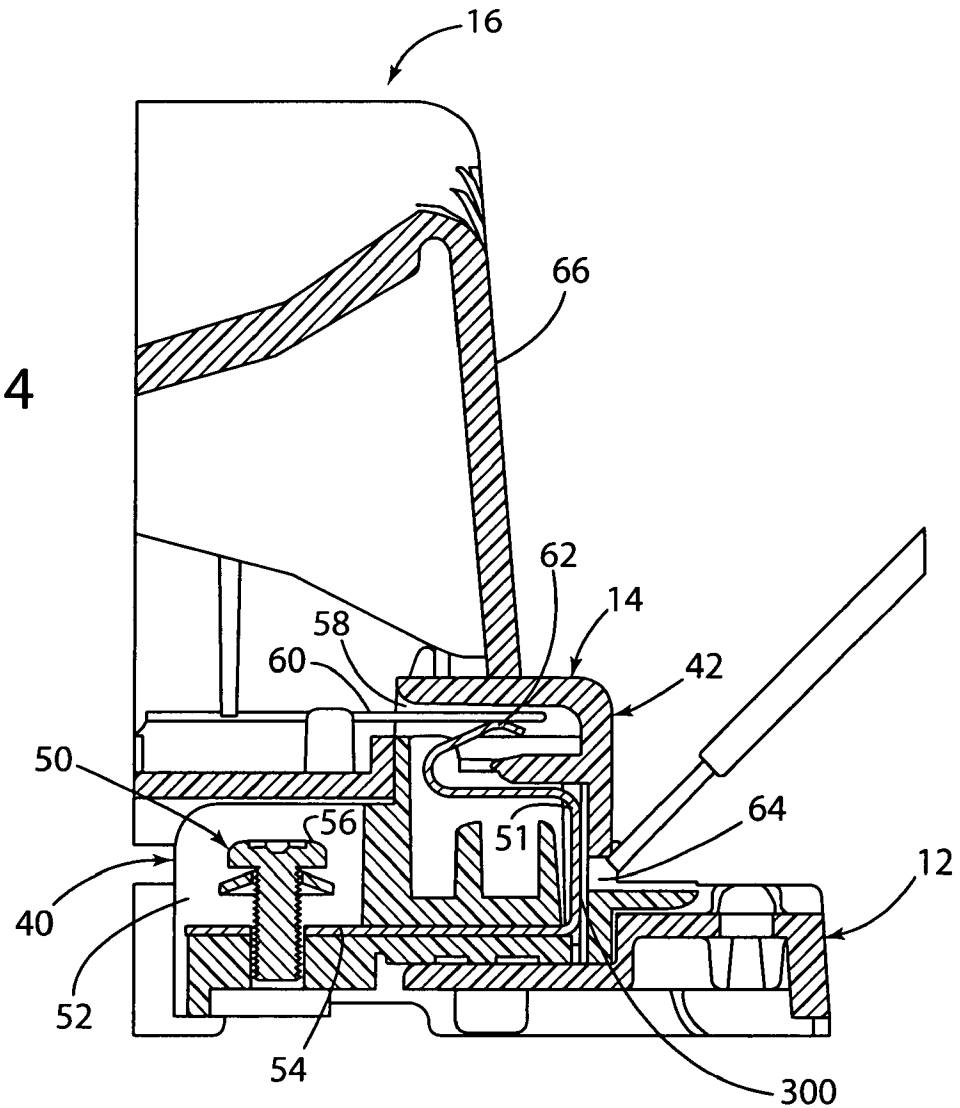
FIG. 4 is a cross-sectional view of the mounting plate and terminal clip of the evacuation appliance along with a notification device of the evacuation appliance embodying the present invention during testing taken along the line IV-IV of FIG. 3.
Figure 5A:
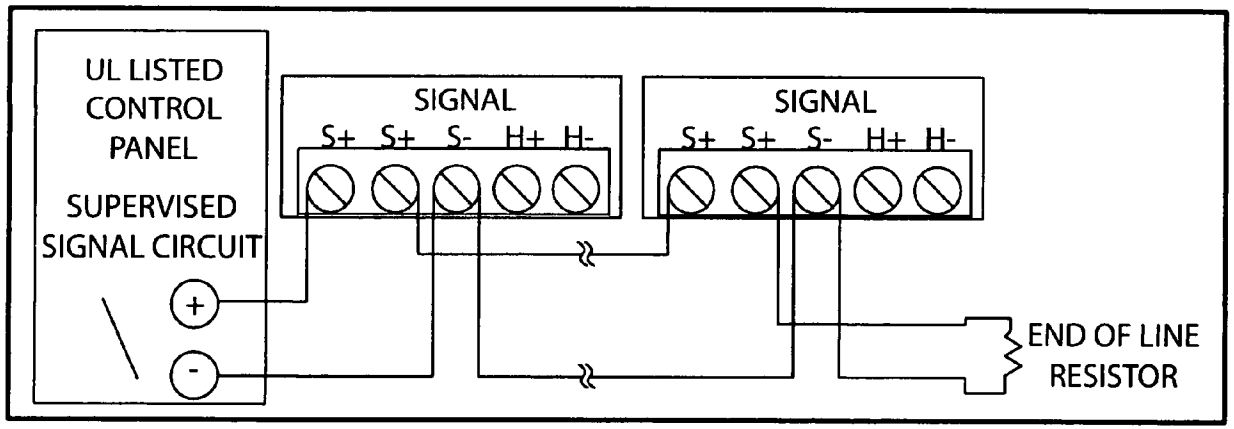
FIGS. 5A and 5B illustrate a connection configuration of a plurality of the evacuation appliances embodying the present invention.
Figure 5B:
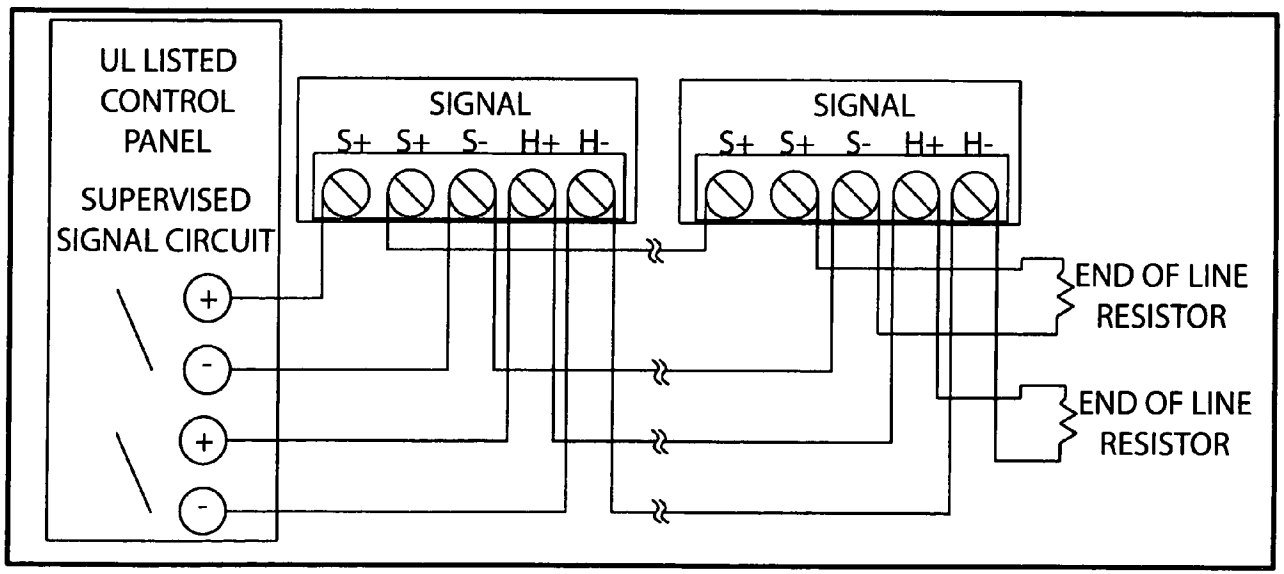
Figure 6:
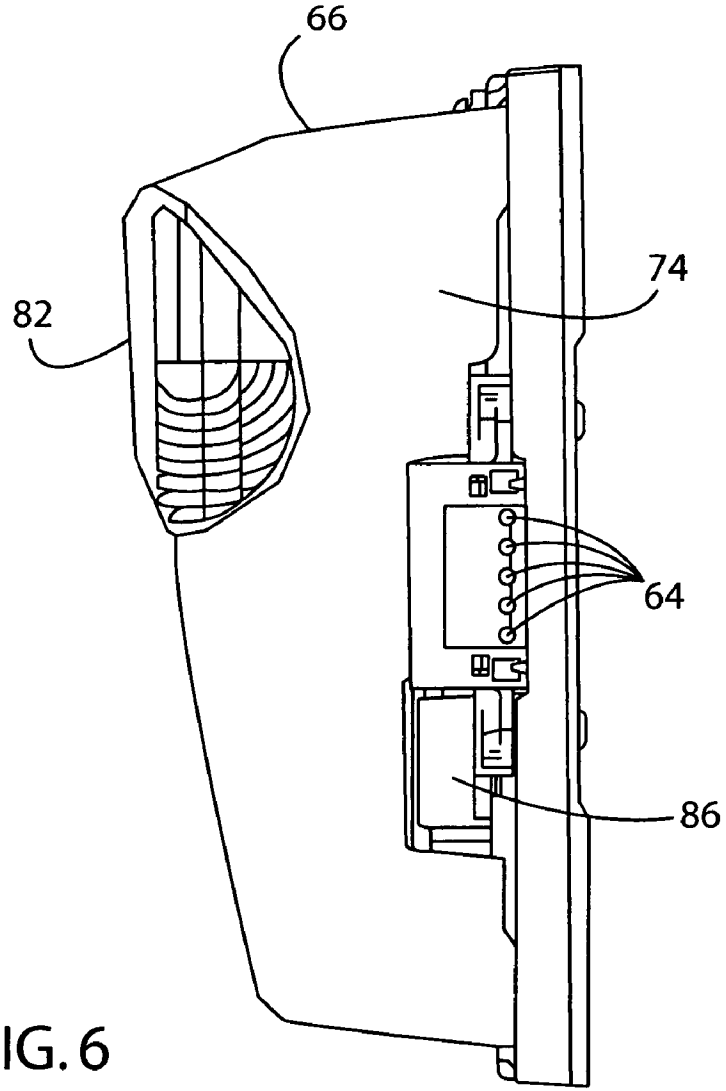
FIG. 6 is a side view of the evacuation appliance embodying the present invention.
Figure 7:
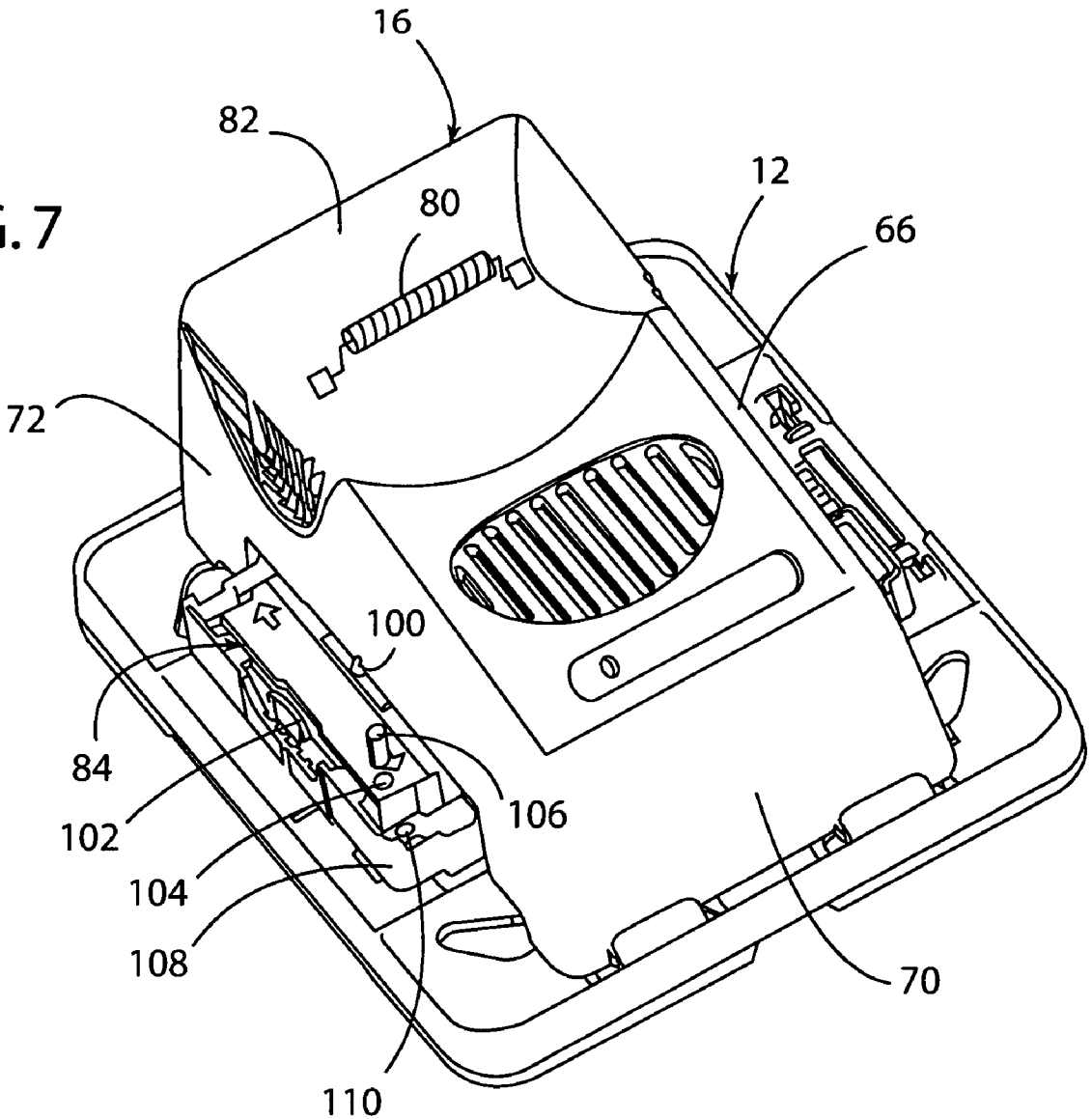
FIG. 7 is a second perspective view of the evacuation appliance embodying the present invention with showing an illumination selector and a pin for the illumination selector.
Figure 8:
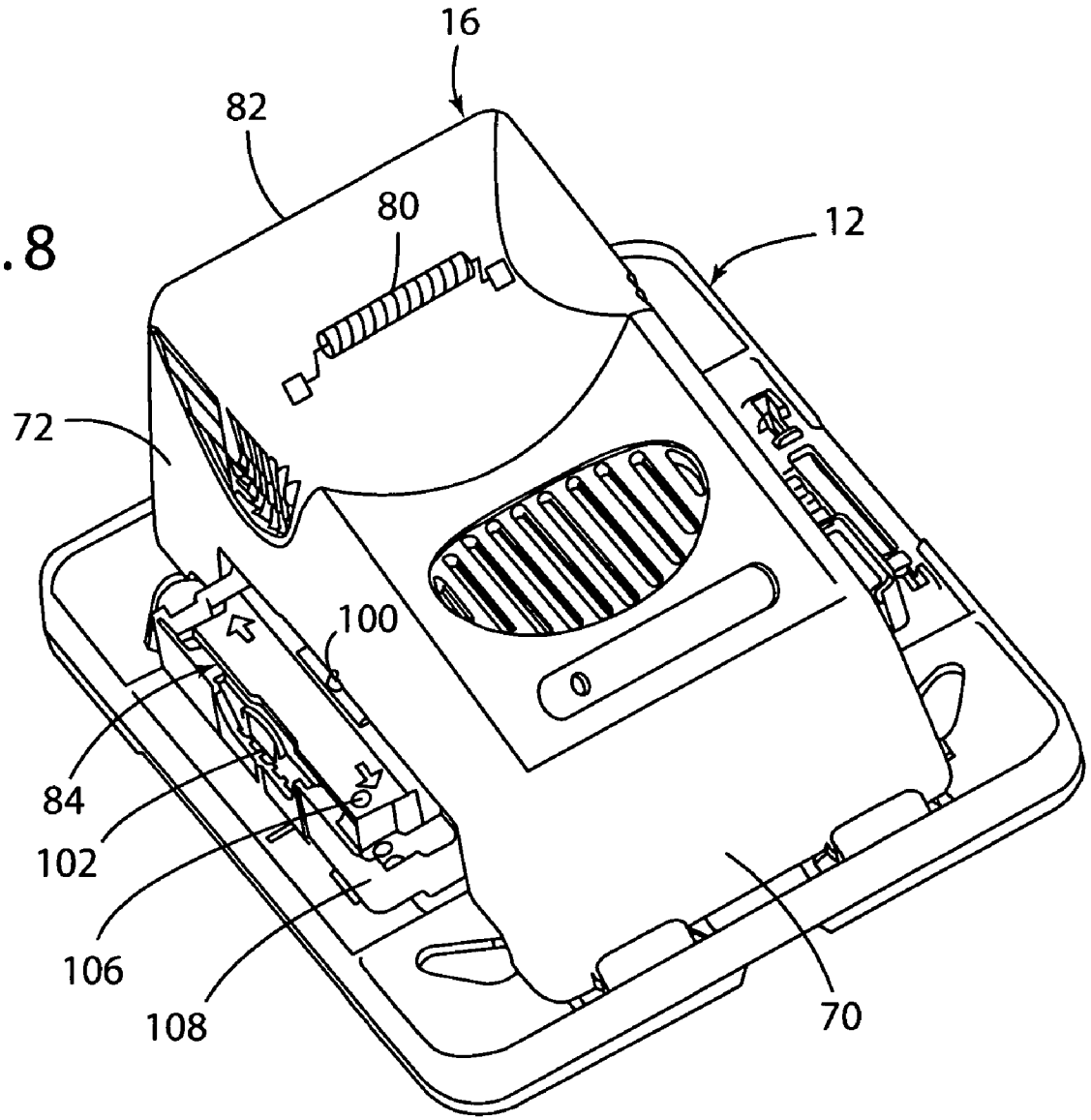
FIG. 8 is the second perspective view of the evacuation appliance embodying the present invention showing the pin in the illumination selector.
Figure 9:
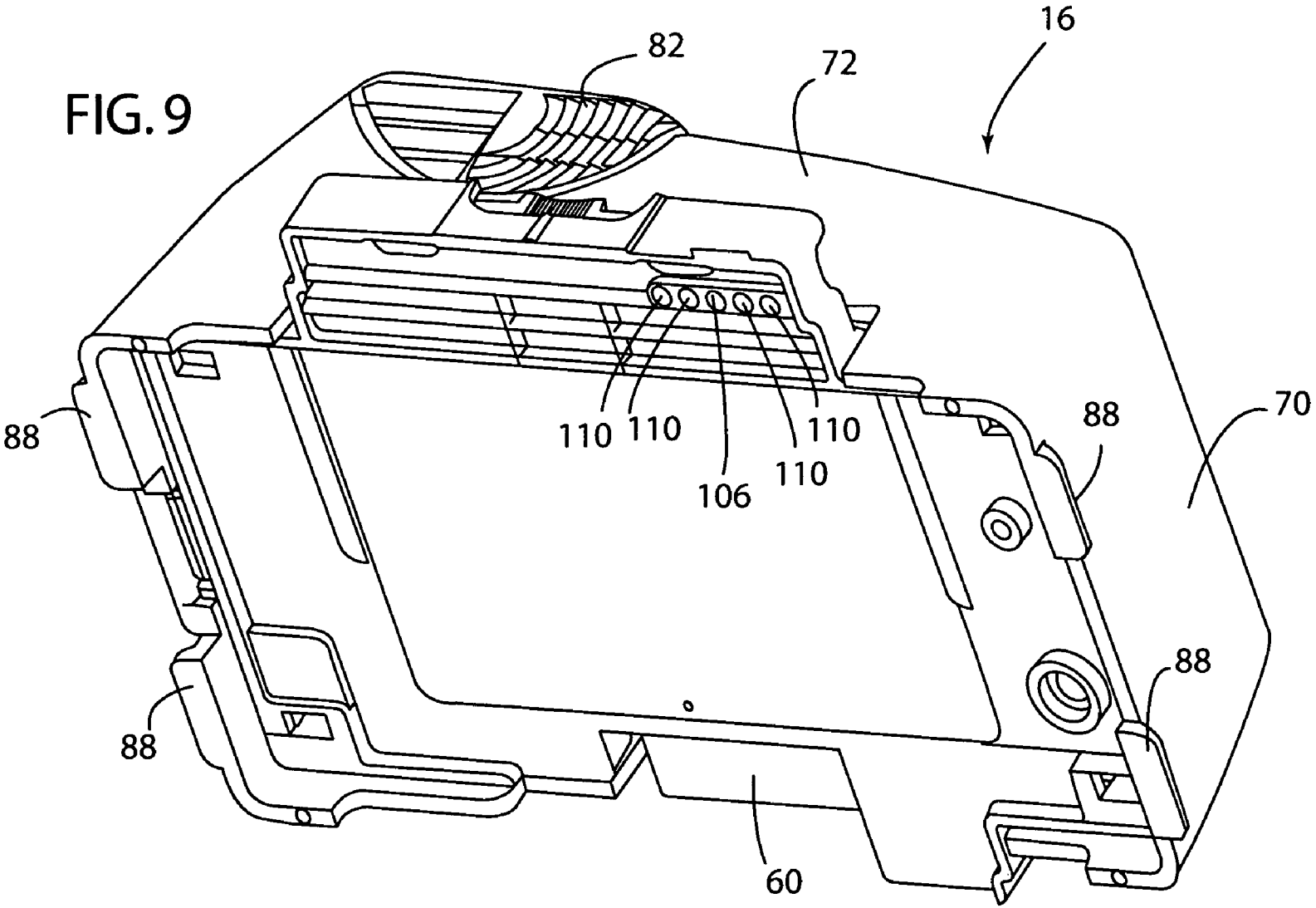
FIG. 9 is a bottom perspective view of the notification device embodying the present invention.
Figure 10:
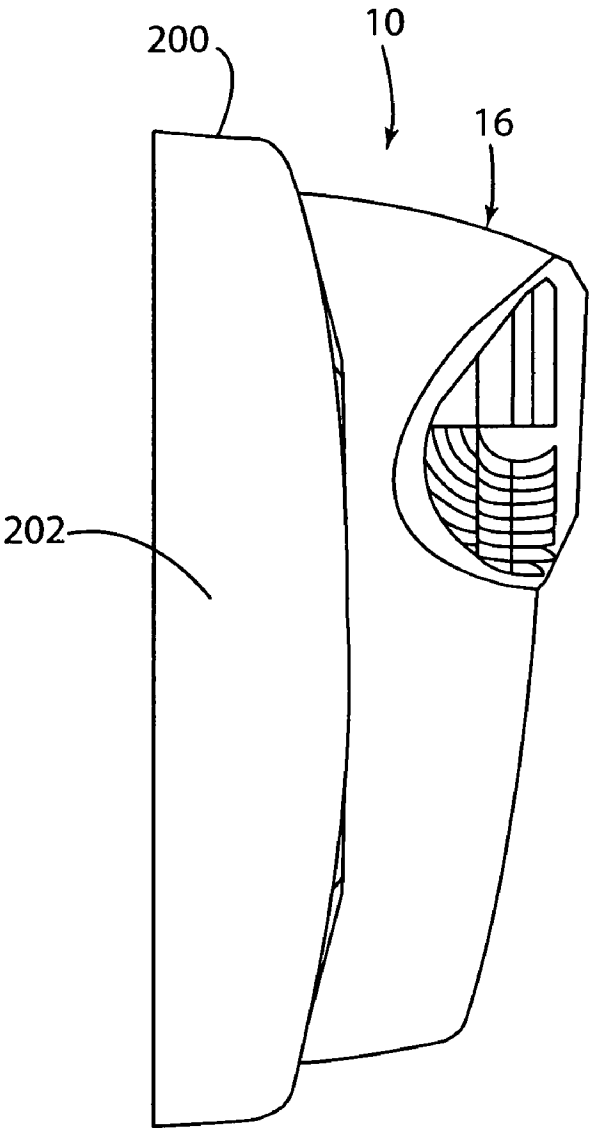
FIG. 10 is a side view of the evacuation appliance embodying the present invention having a bezel.

The illustrated terminal clip 14 (FIGS. 2 and 4) engages the notification device 16 to form an electrical connection between the wiring of a building and the notification device 16. The terminal clip 14 includes a building wire connection portion 40 and a notification device accepting portion 42. The notification device accepting portion 42 includes a lower periphery conforming to the shape of the terminal clip recess 24 of the base 21 of the mounting plate 12. The notification device accepting portion 42 includes a pair of side flanges 44 having openings 46 aligned with the pair of openings in the mounting plate 12. The terminal clip 14 is connected to the mounting plate 12 by inserting fasteners through the openings 46 in the notification device accepting portion 42 of the terminal clip 14 and into the openings of the mounting plate 12. The building wire connection portion 40 extends into the center opening 23 in the base 21 of the mounting plate 12 and includes five screw receivers 50 for connection to wiring from the building. Each screw receiver 50 is separated from an adjacent screw receiver by a wall 52. Each screw receiver 50 also includes a contact 54 for engaging to the wires. The wires are securely connected to the contacts 54 by screwing down screws 56 into the screw receivers 50 to clamp the wires between the screws 56 and the contacts 54. However, it is contemplated that the wires could be connected to the terminal clip 14 in any manner or the terminal clip 14 and the wires could be integral. The five screw receivers 50 are designated S+, S+, S−, H+ and H− and are configured to be connected to the wiring as illustrated in FIGS. 5A and 5B. Therefore, the evacuation device 10 is wired to a control panel and other evacuation devices 10 in one of the configurations illustrated in FIGS. 5A and 5A (although other configurations are contemplated).

In the illustrated example, the notification device accepting portion 42 of the terminal clip 14 includes a slot 58 for accepting a portion of a circuit board 60 extending from the notification device 16 when the notification device 16 is connected to the terminal clip 14 and the mounting plate 12. The slot 58 includes five contacts 62 electrically connected to the five screw receivers 50. Therefore, when the notification device 16 is connected to the terminal clip 14 and the mounting plate 12, the notification device 16 will have five connections 51 with the wiring (five of them) through the contacts 62 in the slot 58 and the screw receivers 50. As illustrated in FIGS. 1, 2, 4 and 6, a side of the notification device accepting portion 42 opposite the slot 58 includes five openings 64, each having a test node 300 therein. The test nodes 300 are individually connected to the five connections as discussed in more detail below.

The illustrated notification device 16 includes at least one notification member 18 for notifying people adjacent the evacuation appliance 10 of an evacuation situation. For example, the evacuation situation could be a fire in the building. The at least one notification member 18 can include an audible notification, a visual notification or a combination of the audible and visual notification. The notification device 16 includes a housing 66 having the at least one notification member 18 therein. The housing 66 preferably includes a top wall 68, a bottom wall 70, a first side wall 72, a second side wall 74 and a front face 76. The front face 76 preferably includes a plurality of slots 78 for allowing an audible notification from the at least one notification member 18 that emits the audible notification to exit the notification device 16 easily. The front face 76 also preferably includes a light 80 located behind a front transparent or translucent shield 82. The first side wall 72 includes a slide member 84 for selecting a candela of the at least one notification member 18 that emits light. The second side wall 74 includes the circuit board 60 extending therefrom and a sound selection device 86.

In the illustrated example, the notification device 16 is slid onto the mounting plate 12 to connect the notification device 16 to the mounting plate 12. The top wall 68 and the bottom wall 70 of the notification device 16 each include a pair of connection flanges 88 extending upward and downward, respectively. In order to connect the notification device 16 to the mounting plate 12, the notification device 16 is positioned on the base 21 of the mounting plate, with the connection flanges 88 positioned to the left of the upper flanges 32 and the lower flanges 34 of the base 21. The notification device 16 is then slid to the right, thereby moving the connection flanges 88 of the notification device 16 under the upper flanges 32 and the lower flanges of the base 21. The connection flanges 88 preferably include a nub on a top thereof configured to abut a bottom of the upper flanges 32 and lower flanges 34 to frictionally connect the notification device 16 to the mounting plate 12. Furthermore, as the notification device 16 is slid to the right, the circuit board 60 will slide into the slot 58 of the terminal clip 14. The circuit board 60 includes five traces on a bottom surface thereof to electrically connect the notification device 16 to the five connections as discussed above. When the notification device 16 is fully connected to the mounting plate 12, a fastener can be inserted through an opening in the front face 76 of the notification device 16 and into the device opening 38 of the lower panel 30 of the base 21 of the mounting plate 12 to securely connect the notification device 16 to the mounting plate 12.

Figure 12:
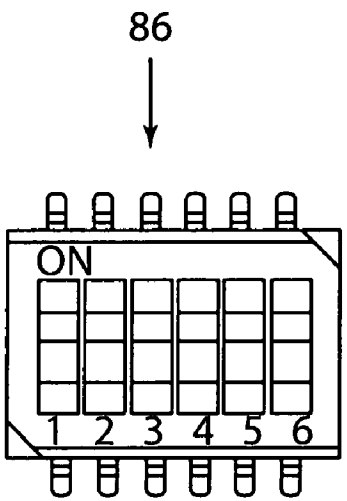
FIG. 12 illustrates a sound selection device of the evacuation appliance embodying the present invention.
Figure 11:
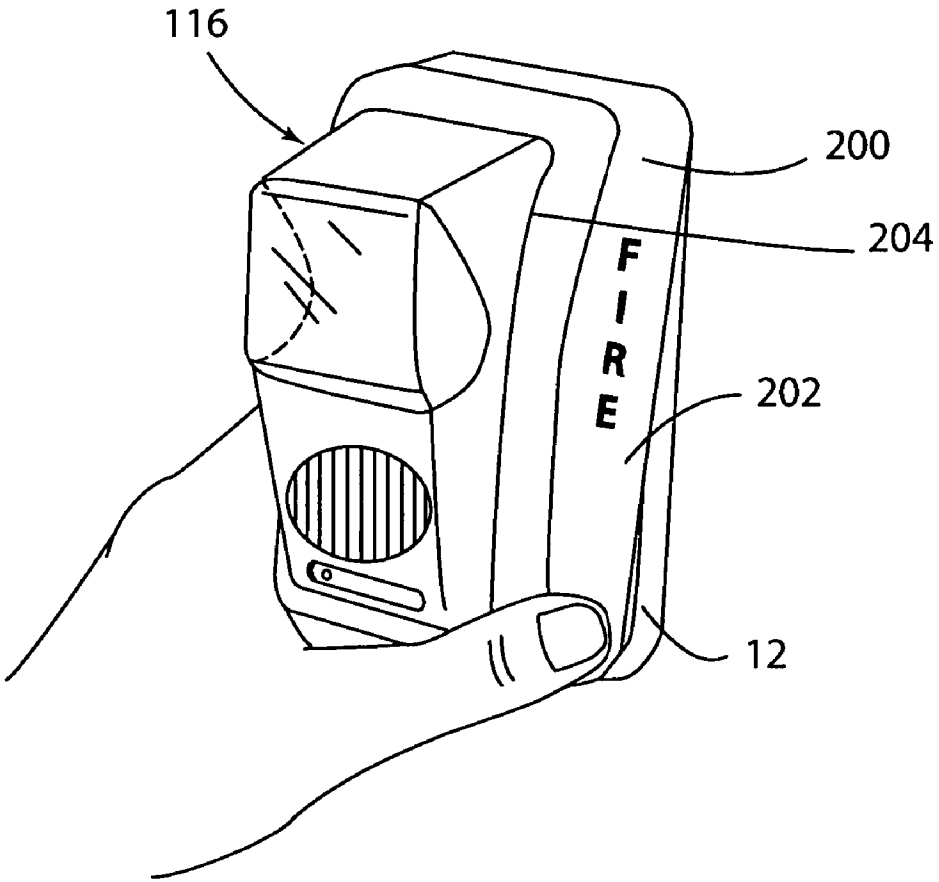
FIG. 11 is a perspective view of the evacuation appliance embodying the present invention having a bezel.

The illustrated at least one notification member 18 of the notification device 16 that emits an audible signal is preferably adjustable to select any one of a number of audible signals using the sound selection device 86 (FIG. 12). Furthermore, in a preferred embodiment, the sound selection device 86 can also be used to select either the sound or the light notification individually. The sound selection device 86 preferably includes six switches which are designated switch 1, switch 2, switch 3, switch 4, switch 5 and switch 6, with each switch having an on position and an off position. In a preferred embodiment, the audible sound can be a chime, a whoop, a mechanical sound or a 2400 Hz tone. Furthermore, each selection can have either a high dB or a low dB. Moreover, each selection can be continuous or interrupted. Switch 1 and switch 2 are used to select either the audible notification or the visual notification. Switch 1 turns the audible notification on and off and switch 2 turns the visual notification on and off. Furthermore, switch 6 is used to select either the high dB or the low dB. The remaining switches are used to select the audible sound according to the following chart:

| | Switch Position | | |
|---|---|---|---|
| Sound: | 3 | 4 | 5 |
| Interrupted Mechanical | ON | ON | ON |
| Continuous Mechanical | OFF | ON | ON |
| Interrupted 2400 Hz | ON | OFF | ON |
| Continuous 2400 Hz | OFF | OFF | ON |
| Interrupted Chime | ON | ON | OFF |
| Continuous Chime | OFF | ON | OFF |
| Whoop | ON | OFF | OFF |
| Whoop | OFF | OFF | OFF |

As can be seen from the above chart, the whoop sound preferably does not have either a continuous or interrupted selection as the sound only has one selection.

In the illustrated example, the visual notification of the at least one notification member 18 of the notification device 16 includes activation of the light 80. Preferably, the light 80 is a strobe light. Furthermore, the light 80 preferably emits a selected one of 15, 30, 60, 75 and 110 candella. However, it is contemplated that the light could be continuous or could emit light at any number of intensities. The illustrated slide member 84 is slid to select one of the desired intensities. The slide member 84 includes the intensities written on a top thereof that are visible from a front of the notification device 16 without removing the notification device 16 from the mounting plate 12. The slide member 84 is slid to align the intensity with a prong 100 on the housing to select that intensity. The slide member 84 preferably includes a depressible tab 102 that has to be depressed to allow the slide member 84 to slide. The tab 102 includes a projection that fits into recesses on a slide member base 108 located below and to a side of the slide member 84. Therefore, the tab 102 has to be depressed to move the slide member 84.

The illustrated slide member 84 preferably includes a hole 104 configured to accept a pin 106 therein for locking the slide member 84 in a selected position. A slide member base 108 located below the slide member 84 preferably includes a plurality of apertures 110 configured to be aligned with the hole 104 in the slide member 84. During use, the intensity is selected using the slide member 84. Thereafter, the pin 106 is inserted into the hole 104 and into one of the apertures 110 to lock the slide member 84 in position. In order to change the intensity of the light 80, the pin 106 must first be removed from the hole 104 and the associated aperture 110. This is done by pressing the pin 106 through the hole 104 and the associated aperture 110 and through the bottom of the slide member base 108. However, when the notification device 16 is connected to the mounting plate 12, the pin 106 will abut against a top of the mounting plate 12. Therefore, the pin 106 can only be removed by first removing the notification device 16 from the mounting plate 12 for security.

The illustrated evacuation device 10 can also include a bezel 200 that snaps over the mounting bracket 12 and the notification device 16. The bezel 200 includes a side wall 202 and a front opening 204. The notification device 16 is configured to extend through the front opening 204 when the bezel 200 is connected to the mounting plate 12. The side wall 202 of the bezel 200 includes a plurality of tabs that snap under the mounting plate 12 to connect the bezel 200 to the mounting plate 12.

In the illustrated embodiment, the terminal clip 14 includes the test nodes 300 for testing the evacuation device 10. The test nodes 300 are configured to be contacted by a test lead 302 in order to ensure that all of the five connections are properly connected. The test leads 302 measure a voltage across the notification device 16. Since the test nodes 300 are exposed when the notification device 16 is connected to the mounting plate 12, the evacuation device 10 can be tested without removing the notification device 16 from the mounting plate 12. Therefore, the evacuation device 10 can be tested after it is installed by only removing the bezel 200 or before the bezel 200 is connected to the mounting plate 12. Furthermore, the evacuation device 10 can be tested easily to determine which device in a series of devices is not working properly without taking each evacuation device 10 apart. Therefore, the evacuation device 10 can be easily tested in a non-intrusive manner. Accordingly, there is no need to remove the notification device 16 from the mounting plate 12, the wiring to the evacuation appliance 10 and a source for signaling the evacuation appliance 10 in order to gain access to the terminals as there is provided a hole or series of holes having the node or nodes 300 therein through which testing could be performed using test leads 302. Furthermore, one of the evacuation appliances 10 in a series of evacuation appliances can be deliberately short circuited to check the source for signaling the evacuation appliance 10 to ensure the source is working correctly. However, the test nodes 300 are preferably used during installation to demonstrate that the installation has been completely correctly or to locate wiring issues.

Another embodiment of the present invention provides the test nodes 300 accessible outside of the side wall of the bezel 200 but still concealed by a protective outside housing. This would be used in a situation where aesthetics are significant as there would be no holes or access ports on the exterior of the device. Additionally, it is contemplated that the printed circuit board can be directly accessed via holes in the housing of the notification device or a tab coming through the housing. Furthermore, it is contemplated that the evacuation device 10 could have a system wherein the evacuation device 10 could be tested remotely by using a signal. For example, the evacuation device 10 could be tested by sending a radio or Bluetooth signal to the evacuation device 10.

It is to be understood that variations and modifications can be made on the aforementioned structure without departing from the concepts of the present invention, and further it is to be understood that such concepts are intended to be covered by the following claims unless these claims by their language expressly state otherwise.

I claim:

1. An evacuation appliance comprising:

a mounting plate configured to be connected to a wall, the mounting plate having a terminal clip;

a notification device having at least one notification member, the notification device being configured to be connected to the mounting plate to electronically connect the terminal clip to the at least one notification member to power the at least one notification member;

the mounting plate and the notification device comprising an accessible testing system, such that when the mounting plate and the notification device are connected, the notification device can be measured using the accessible testing system to determine if the notification device is properly receiving power from the terminal clip without disconnecting the notification device from the mounting plate.

2. The evacuation appliance of claim 1, wherein:

the at least one notification member comprises a visual notification.

3. The evacuation appliance of claim 2, wherein:

the visual notification is a strobe light.

4. The evacuation appliance of claim 2, wherein:

the at least one notification member further comprises an audible notification.

5. The evacuation appliance of claim 4, wherein:

the audible notification comprises a horn.

6. The evacuation appliance of claim 2, wherein:

the notification device includes a slide member for selecting an intensity of illumination of the visual notification.

7. The evacuation appliance of claim 1, wherein:

the at least one notification member comprises an audible notification.

8. The evacuation appliance of claim 7, wherein:

the audible notification comprises a horn.

9. The evacuation appliance of claim 1, wherein:

the testing system comprises at least one test node for measuring a voltage across the notification device.

10. The evacuation appliance of claim 9, wherein:

the terminal clip includes the at least one test node.

11. An evacuation appliance comprising:

a mounting plate configured to be connected to a wall, the mounting plate having a terminal clip;

a notification device having at least one notification member, the notification device being configured to be connected to the mounting plate to electronically connect the terminal clip to the at least one notification member to power the at least one notification member;

wherein the mounting plate and the notification device comprising an accessible testing system, such that when the mounting plate and the notification device are connected, the notification device can be measured using the accessible testing system to determine if the notification device is properly receiving power from the terminal clip without disconnecting the notification device from the mounting plate;

the at least one notification member comprises a visual notification;

the notification device includes a slide member for selecting an intensity of illumination of the visual notification; and the slide member includes a locking member for locking the slide member in a selected position, the locking member only being removable from the slide member by removing the notification device from the mounting plate.

12. A method of testing an evacuation appliance comprising:

providing a mounting plate configured to be connected to a wall, the mounting plate having a terminal clip;

providing a notification device having at least one notification member;

connecting the notification device to the mounting plate to electronically connect the terminal clip to the at least one notification member to power the at least one notification member;

testing the at least one notification member using an accessible testing system to determine if the notification device is properly receiving power from the terminal clip without disconnecting the notification device from the mounting plate.

13. The method of testing an evacuation appliance of claim 12, wherein:

the at least one notification member comprises a visual notification.

14. The method of testing an evacuation appliance of claim 13, wherein:

the visual notification is a strobe light.

15. The method of testing an evacuation appliance of claim 13, wherein:

the at least one notification member further comprises an audible notification.

16. The method of testing an evacuation appliance of claim 15, wherein:

the audible notification comprises a horn.

17. The method of testing an evacuation appliance of claim 13, wherein:

the notification device includes a slide member for selecting an intensity of illumination of the visual notification.

18. The method of testing an evacuation appliance of claim 12, wherein:

the at least one notification member comprises an audible notification.

19. The method of testing an evacuation appliance of claim 18, wherein:

the audible notification comprises a horn.

20. The method of testing an evacuation appliance of claim 12, wherein:

the testing system comprises at least one test node for measuring a voltage across the notification device.

21. The method of testing an evacuation appliance of claim 20, wherein:

the terminal clip includes the at least one test node.

22. The method of testing an evacuation appliance of claim 12, wherein:

testing comprises contacting the accessible testing system with a testing device.

23. The method of testing an evacuation appliance of claim 12, further including:

connecting wiring to the terminal clip, the wiring providing power to the notification device;

wherein the testing of the at least one notification member is accomplished without disconnecting the terminal clip from the wiring.

24. A method of testing an evacuation appliance comprising:

providing a mounting plate configured to be connected to a wall, the mounting plate having a terminal clip;

providing a notification device having at least one notification member;

connecting the notification device to the mounting plate to electronically connect the terminal clip to the at least one notification member to power the at least one notification member;

testing the at least one notification member using an accessible testing system to determine if the notification device is properly receiving power from the terminal clip without disconnecting the notification device from the mounting plate;

wherein the at least one notification member comprises a visual notification;

the notification device includes a slide member for selecting an intensity of illumination of the visual notification; and the slide member includes a locking member for locking the slide member in a selected position, the locking member only being removable from the slide member by removing the notification device from the mounting plate.

* * * * *

UNITED STATES PATENT AND TRADEMARK OFFICE

CERTIFICATE OF CORRECTION

PATENT NO. : 7,375,617 B2
APPLICATION NO. : 11/358025
DATED : May 20, 2008
INVENTOR(S) : Stirling It is certified that error appears in the above-identified patent and that said Letters Patent is hereby corrected as shown below:

Column 4, Line 10;
"FIGS. 5A and 5A" should be --FIGS. 5A and 5B--.

Signed and Sealed this

Fourth Day of November, 2008

JON W. DUDAS
*Director of the United States Patent and Trademark Office*